US012546088B2

(12) United States Patent
Hill et al.

(10) Patent No.: US 12,546,088 B2
(45) Date of Patent: Feb. 10, 2026

(54) OPTIMIZING BLADE ENGAGEMENT DEPTH USING ENGINE LOAD DATA

(71) Applicant: Trimble Inc., Sunnyvale, CA (US)

(72) Inventors: Jason Hill, Superior, CO (US); Mark Gibson, Portland, OR (US)

(73) Assignee: Trimble Inc., Westminster, CO (US)

( * ) Notice: Subject to any disclaimer, the term of this patent is extended or adjusted under 35 U.S.C. 154(b) by 793 days.

(21) Appl. No.: 17/565,021

(22) Filed: Dec. 29, 2021

(65) Prior Publication Data

US 2023/0203778 A1 Jun. 29, 2023

(51) Int. Cl.
*E02F 3/84* (2006.01)
*E02F 3/76* (2006.01)

(52) U.S. Cl.
CPC ..... *E02F 3/844* (2013.01); *E02F 3/7622* (2013.01)

(58) Field of Classification Search
CPC ..... E02F 3/844; E02F 3/7622
See application file for complete search history.

(56) References Cited

U.S. PATENT DOCUMENTS

2007/0131438 A1* 6/2007 Brandt ..... E02F 9/2203 172/464
2008/0127530 A1* 6/2008 Kelly ..... E02F 9/2029 37/403
2015/0361640 A1* 12/2015 Faivre ..... E02F 3/436 701/50
2016/0122969 A1* 5/2016 Noborio ..... E02F 9/262 701/50
2018/0119387 A1* 5/2018 Sherlock ..... E02F 5/32
2020/0325653 A1* 10/2020 Hageman ..... E02F 9/265

FOREIGN PATENT DOCUMENTS

JP 2017-172189 A 9/2017

OTHER PUBLICATIONS

C658733 D8T tractor manual Caterpillar 2013 (Year: 2013).*
Extended European Search Report for Application No. 22214212.7-1002, completion of search report Apr. 21, 2023, 6 pages.

* cited by examiner

*Primary Examiner* — Navid Z. Mehdizadeh
*Assistant Examiner* — Oliver Tan
(74) *Attorney, Agent, or Firm* — Kilpatrick Townsend & Stockton LLP

(57) ABSTRACT

A control device receives, from an engine load sensor device, a value of an engine load of an engine of an equipment operating in an operating environment. The control device compares the value of the engine load to a target engine load range defined by a minimum target engine load value and a maximum target engine load value. Responsive to determining that the value of the engine load is less than the minimum target engine load value, the control device lowers a cutting blade of the equipment to increase an engagement of the cutting blade with a surface or subsurface. Responsive to determining that the engine load is greater than the maximum target engine load value, the control device raises the cutting blade of the equipment to decrease the engagement of the cutting blade with the surface or subsurface.

15 Claims, 5 Drawing Sheets

OPTIMIZING BLADE ENGAGEMENT DEPTH USING ENGINE LOAD DATA

TECHNICAL FIELD

This disclosure generally relates to systems for automating an operation of equipment. More specifically, but not by way of limitation, this disclosure relates to automating an operation of equipment to respond to changes in engine data.

BACKGROUND

To ensure efficient use of land, it is often necessary to modify physical surface features of the land to eliminate low areas that may pool water, or high spots where erosion or dry patches may occur. Further, it is often necessary to modify subsurface features for subsurface water management. One way to change physical surface features or physical subsurface features is to use equipment (e.g. a tractor or other work vehicle) that applies an adjustable blade to modify the physical surface and/or subsurface features. Modifying the physical surface/subsurface features of the land often requires multiple passes of the blade over various regions of the land, gradually modifying the physical features with each pass of the blade until a predetermined design is achieved. In conventional systems, an operator manually adjusts a blade height to control a level of engagement of the blade with the surface or subsurface. However, the manual blade operation in conventional systems does not maintain an optimum blade engagement level with the land. This decreases the effectiveness of the blade application toward reaching the predetermined design, which requires the tractor to pass over the land more times than necessary. In conventional systems, the equipment is operated inefficiently as engine output is wasted when the blade engagement depth is less than what the equipment is capable of achieving.

SUMMARY

Certain embodiments involve automatically adjusting a blade height during operation of a tractor to maintain a target engine load, according to certain embodiments described in the present disclosure. A control device receives, from an engine load sensor device, a value of an engine load of an engine of an equipment operating in an operating environment. The control device compares the value of the engine load to a target engine load range defined by a minimum target engine load value and a maximum target engine load value. Responsive to determining that the value of the engine load is less than the minimum target engine load value, the control device lowers a cutting blade of the equipment to increase an engagement of the cutting blade with a surface or subsurface. Responsive to determining that the engine load is greater than the maximum target engine load value, the control device raises the cutting blade of the equipment to decrease the engagement of the cutting blade with the surface or subsurface.

These illustrative embodiments are mentioned not to limit or define the disclosure, but to provide examples to aid understanding thereof. Additional embodiments are discussed in the Detailed Description, and further description is provided there.

BRIEF DESCRIPTION OF THE DRAWINGS

Features, embodiments, and advantages of the present disclosure are better understood when the following Detailed Description is read with reference to the accompanying drawings.

DETAILED DESCRIPTION

Figure 1:
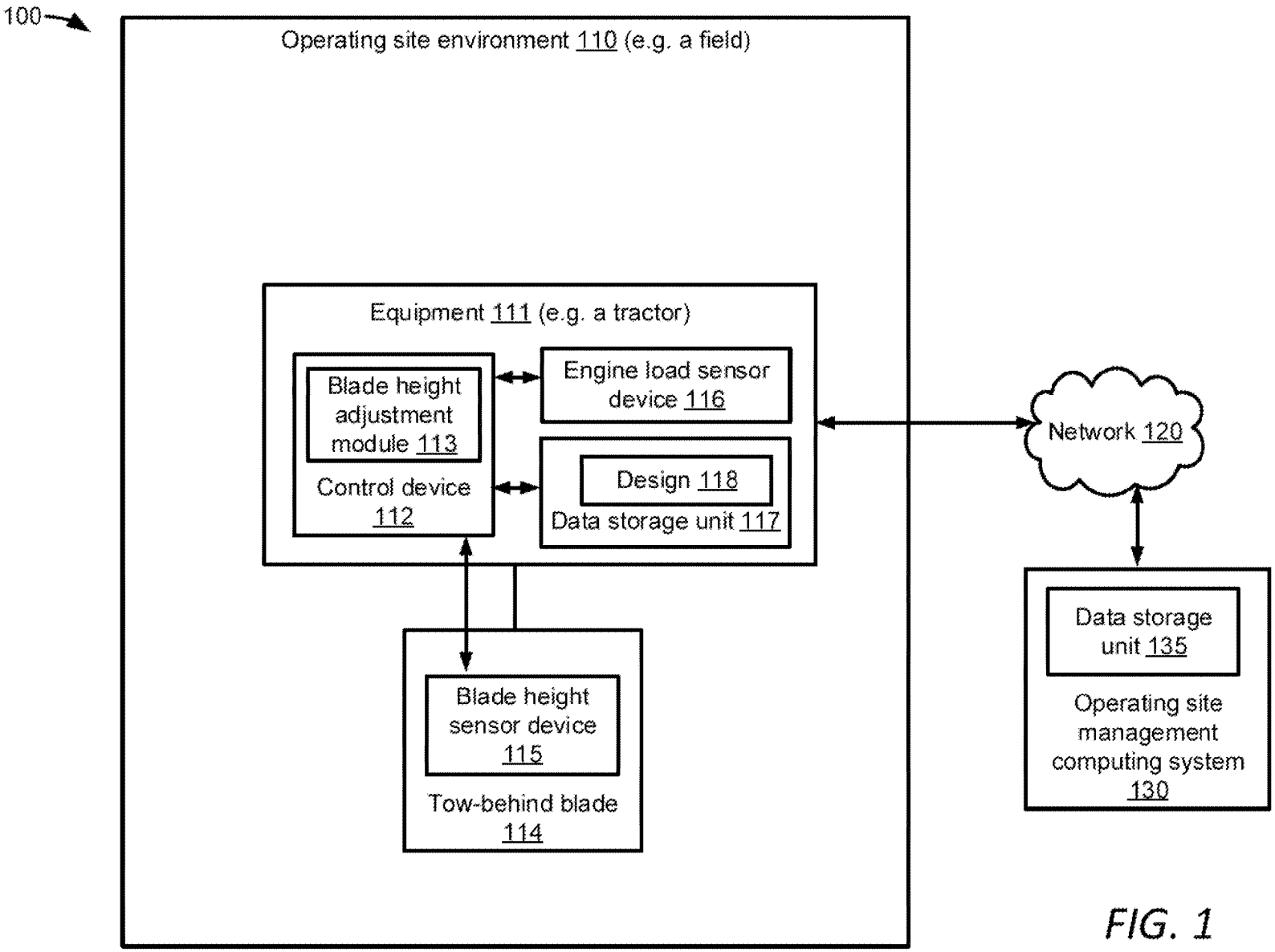
FIG. 1 depicts an example of a computing environment for automatically adjusting a blade height during operation of an equipment to maintain a target engine load, according to certain embodiments described in the present disclosure.

The present disclosure involves automatically adjusting a blade height during operation of a tractor to maintain a target engine load. For instance, as explained above, conventional systems rely on manual blade adjustment during tractor operation. Therefore, the blade operation of conventional systems are not able to perform well in environments with changing topography or other situations in which frequent adjustments to a degree of blade engagement with the land is necessary to keep the tractor system operating at an optimal output. Certain embodiments described herein can avoid one or more of these problems by, for example, monitoring an engine load and making adjustments to a depth of blade engagement with the land to keep the monitored engine load within a target range, which provides for the most effective application of the blade. Working land with as great a blade engagement depth as possible, while remaining within constraints of a design and a target engine load range, as provided for in the system and methods described herein, results in less passes of the equipment and blade over the same region of land than would be required if the land were worked with a lesser blade engagement depth. Accordingly, the system and methods for automatic blade adjustment described in certain embodiments herein reduces consumption of time and fuel resources by allowing for completion of a design with less passes of the blade and enabling operation of the equipment in a more efficient manner.

The following non-limiting example is provided to introduce certain embodiments. An equipment (e.g. a tractor with a pull behind blade) includes a control device and, during operation of the equipment, the control device determines a current engine load of the equipment (e.g. a torque of the engine). In some embodiments, during operation of the equipment, a blade (e.g. a pull behind blade) is configured to engage with a surface or subsurface of land to modify physical features of the land. For example, the blade may be configured to engage with the surface of the land, cutting into and/or dragging dirt to grade the land to a desired design. In another example, the blade is configured during operation of the equipment to cut a trench or ditch within the subsurface or surface of the land to achieve a desired design. In certain embodiments, the control device monitors a current engine load during operation of the equipment. A current engine load may be expressed as a percentage (e.g. engine load is at 90%) or other value. In certain embodiments, the equipment includes one or more sensors that detect one or more operating conditions or outputs of the engine and a computing device of the equipment calculates or otherwise determines a current engine load. For example, the computing device of the equipment determines the engine load at regular predefined intervals (e.g. every second, every five seconds, or other predefined interval) and communicates the engine load determination to the control device. The control device continuously or periodically receives current engine load values from the computing device of the equipment. In certain embodiments, the computing device of the equipment periodically or continuously receives current engine load data from a controller area network (CAN) or other similar communication protocol.

The control device compares the current engine load to a target engine load range. For example, the target engine load range includes a minimum target engine load value and a maximum target engine load value. In certain embodiments, the target engine load range is an engine load range at which the land modification function of the equipment (e.g. by application of the blade to the surface or subsurface of the land) is most efficient. In some instances, one or more functions of the equipment during an operation of the equipment contributes to the engine load. In some instances, an incline of the land over which the equipment is moving (e.g. uphill) further contributes to engine load. For example, the greater the uphill incline, the greater the engine load. In some instances, a hardness or softness of the land over which the equipment is moving affects the engine load. For example, as a hardness or other resistance of the surface or subsurface of the land upon which the blade is engaging increases, the engine load increases. In some instances, the moisture content of the land affects the engine load. For example, an equipment operating a blade on land that has a higher moisture content (e.g. more wet) may experience a higher engine load than the equipment operating the blade on land that has a lower moisture content (e.g. more dry), other conditions of the land being the same. For example, an engine load may increase as the moisture content of the land upon which the equipment is operating is increased, if all other conditions (e.g. slope/incline, temperature, etc.) remain the same. Further, a blade engagement with the surface or subsurface of the land (e.g. how far into the surface/surface the blade is inserted) further contributes to engine load. For example, as an extent of blade engagement with the surface or subsurface is increased, the engine load increases. Accordingly, lowering the blade to increase blade engagement generally increases the engine load and raising the blade to decrease blade engagement generally decreases the engine load. In certain examples, instead of a target engine load range, the current engine load is compared to a target engine load value.

In an example, upon comparing the current engine load to the target engine load range, the control device determines that the current engine load is less than the target engine load range. In this example, the control device lowers the blade height, which increases the blade engagement and increases the engine load. In certain embodiments, the control device calculates an amount by which to lower the blade height to increase the engine load to within the target engine load range and lowers the blade height by the calculated amount. In certain embodiments, the control devices calculates a blade height setting, of a set of possible blade height settings, expected to increase the engine load to within the target engine load range. In another embodiment, the control device lowers the blade height by a predefined incremental amount, determines the subsequent engine load, compares the subsequent engine load to the target load range, and further lowers the blade height by the predefined incremental amount. In this other embodiment, the control device iteratively lowers the blade height by the predefined incremental amount until the engine load is determined to be within the target engine load range. After lowering the blade height, the control device continues to monitor, continuously or periodically, the engine load of the equipment.

In another example, upon comparing the current engine load to the target engine load range, the control device determines that the current engine load is more than the target engine load range. In this example, the control device raises the blade height, which decreases the blade engagement and decreases the engine load. In certain embodiments, the control device calculates an amount by which to raise the blade height to decrease the engine load to within the target engine load range and raises the blade height by the calculated amount. In certain embodiments, the control device calculates a blade height setting, of a set of possible blade height settings, expected to decrease the engine load to within the target engine load range. In another embodiment, the control device raises the blade height by a predefined incremental amount, determines the subsequent engine load, compares the subsequent engine load to the target load range, and further raises the blade height by the predefined incremental amount. In this other embodiment, the control device iteratively raises the blade height by the predefined incremental amount until the engine load is determined to be within the target engine load range. After raising the blade height, the control device continues to monitor, continuously or periodically, the engine load of the equipment.

In an example, upon comparing the current engine load to the target engine load range, the control device determines that the current engine load is within the target engine load range. In this example, no adjustments to the blade height are necessary and the control device continues to monitor, continuously or periodically, the engine load of the equipment. For example, the control device may receive, from the computing device of the equipment, engine load data continuously or periodically. The control device may compare, at regular intervals (e.g. an interval within a range of 5-0.2 hz, or other predefined interval), the current engine load data to the target engine load range and lower or raise the blade height, accordingly, to cause the current engine load to enter or otherwise stay within the target engine load range.

Example of an Operating Environment for Automatically Adjusting a Blade Height During Operation of an Equipment to Maintain a Target Engine Load Range Referring now to the drawings, FIG. 1 depicts an example of a computing environment 100 for automatically adjusting a blade height during operation of an equipment to maintain a target engine load range, according to certain embodiments described in the present disclosure. In some embodiments, the computing environment 100 includes an equipment 111 with a tow-behind blade 114 and an operating site management system 130. The equipment 111 with the tow-behind blade 114 operates in an operating site environment 110

In the example depicted in FIG. 1, an operating site environment 110 is a field or other environment in which the equipment 111 operates to modify one or more physical surface features and/or physical subsurface features of the environment using the tow-behind blade 114. For example, physical surface and/or subsurface features are modified to ensure proper water management (e.g. drainage of water) in the operating site environment 110. In examples described herein, the equipment 111 is a tractor or other work vehicle that is capable of pulling and controlling the tow-behind blade 114 used to modify the operating site environment 110. In other embodiments, instead of a tow-behind blade 114 being pulled by the equipment 111, the equipment 111 includes a blade attached to the equipment 111 (e.g. attached underneath the equipment 111) that performs one or more functions of the tow-behind blade 114 as described herein. In certain embodiments, the functions of the tow-behind blade 114 (or blade that is otherwise a component of or attached to the equipment 111) may include engaging one or more blades with the surface of the operating site environment 110 to cut into and/or drag dirt or other material on the surface of the operating site environment 110. In certain embodiments, the functions of the tow-behind blade 114 include engaging one or more blades with the subsurface of the operating site environment 110 to cut a trench, ditch, or other feature within the subsurface of the operating site environment 110.

The equipment 111 includes a control device 112, an engine load sensor 116, and a data storage unit 117. The control device 112 is able to access a design 118 stored in a data storage unit 117. The design 118 defines how the equipment 111 with the tow-behind blade 114 is to modify the physical features of the surface and/or subsurface of the operating site environment 110. The control device 112 can adjust a blade height of the tow-behind blade 114. Adjusting the tow-behind blade 114 can include raising a blade height of the tow-behind blade 114 to decrease a level of engagement of the tow-behind blade 114 with the surface or subsurface of the operating site environment 110. The level of engagement with the surface or subsurface of the operating site environment 110 is the depth at which the blade of the tow-behind blade 114 is inserted into the surface or subsurface as it is being pulled through the operating site environment 110.

The control device 112 includes a blade height adjustment module 113 which calculates blade height adjustments, during operation of the equipment 111 in the operating site environment 110, based on one or more of blade height information, design 118 information, and engine load information received by or otherwise accessible by the control device 112. The control device 112, in certain embodiments, is communicatively coupled to a blade height sensor 115 of the tow-behind blade 114 and receives, from the blade height sensor 115, blade height information describing a current blade height of the tow-behind blade 114. The blade height adjustment calculation specifies to what distance or other degree to raise or lower the blade from its current level as detected by the blade height sensor 115. The control device 112 adjusts the blade height of the tow-behind blade 114 in accordance with the blade height adjustment calculations of the blade height adjustment module 113.

The blade height adjustment module 113 can calculate a blade height adjustment based on the design 118. For example, the design 118 specifies target surface or subsurface features of one or more areas or regions of the operating site environment 110. The blade height adjustment module 113 also may receive information (e.g. via one or more sensor devices) about current surface or subsurface features of the one or more areas or regions of the operating site environment 110 and compare the target surface/subsurface features to the current surface/subsurface features. The blade height adjustment module 113 calculates, based on the comparison, a blade height (or blade height setting) for the tow-behind blade 114 aimed to change the current features toward the target features. In certain embodiments, the blade height adjustment module 113 determines, based on the design 118, a minimum level at which the blade height may be set in the current area of the operating site environment 110. For example, the blade height adjustment module 113 will not calculate a change in blade height that would result in the blade height being less than the minimum level.

The blade height adjustment module 113 can calculate a blade height adjustment based on engine load information. The control device 112 periodically or continuously receives engine load information from the engine load sensor 116 that describes an engine load or other information describing an operating state of an engine of the equipment 111. Based on the received engine load information, the blade height adjustment module 113 calculates a blade height adjustment to the tow-behind blade based on the received engine load information. The control device 112 adjusts the blade height of the tow-behind blade 114 in accordance with the calculation of the blade height adjustment module 113.

The engine load sensor device 116 determines, periodically at regular intervals or continuously, engine load information describing an engine load of an engine of the equipment 111. The engine load sensor device 116 may include one or more sensors that detect one or more operating conditions or outputs of the engine and calculate or otherwise determines a current engine load based on the one or more operating conditions or outputs. The engine load sensor device 116 communicates engine load information to the control device. The engine load information can be a current detected engine load of the engine. The engine load can be expressed as a percentage, fraction, or other value. In certain embodiments, the engine load sensor 116 is a component of the equipment 111 and is communicatively coupled with the control device 112 via a wired or wireless communication network, for example, a controller area network ("CAN") or a local interconnect network ("LIN"). A wireless communication network could include a Bluetooth network, a Bluetooth low energy ("BLE") network, a Wi-Fi network, a near field communication ("NFC") network, or other wireless communication network. In other embodiments, the control device 112 comprises the engine load sensor device 116 or the engine load sensor device 116 and the control device 112 are both components of another device (e.g. both are components of another computing device of the equipment 111).

The data storage unit 117 includes a local or remote data storage structure accessible to the control device 112 suitable for storing information. In certain embodiments, the control device 112 comprises the data storage unit 117. A data storage unit can store relevant data as one or more files, databases, matrices, computer code, etc. The data can include a design 118 that specifies target surface features or target subsurface features of one or more areas or regions of the operating site environment 110. In certain examples, the design 118 indicates a topography or other measures or bounds describing the target physical surface or subsurface characteristics. For example, the design 118 may indicate target surface heights for each area of a surface of the operating site environment 110. In some instances, the control device 112 may receive the design as input via an operator of the equipment 111 and store the design 118 in the data storage unit 117. In some instances, the control device 112 receives the design 118 from an operating site management computing system 130 via a network 120 and stores the design 118 in the data storage unit 117.

In an embodiment, the tow-behind blade 114 includes a blade or blades that cut into or drag a surface of the operating site environment 110 to grade the operating site environment 110 or otherwise perform surface manipulation. The blade or blades may include a scraper blade arrangement with the capability to cut and carry dirt or other material from the operating site environment 110. In another embodiment, the tow-behind blade 114 includes a blade or blades that cut a trench or ditch within a subsurface of the operating site environment 110. In certain embodiments, the tow-behind blade 114 cuts a trench into the subsurface, installs a perforated pipe (e.g. a tile drain) in the trench and then closes the trench.

The tow-behind blade 114 includes a blade height sensor device 115. In an embodiment, the blade height sensor device 115 includes a global navigation satellite system (GNSS) receiver to communicate with the GNSS and log data (e.g. log geolocation coordinates of a location of the tow-behind blade 114) determined via the GNSS receiver. In this embodiment, using GNSS data, the blade height sensor device 115 can detect a height of the cutting edge with respect to the ground. In this embodiment, the blade height sensor device 115 may further comprise one or more inertial measurement units (IMUs), for example, accelerometers and/or gyroscopes, and can detect pitch, roll, and yaw of the pull-behind blade 114, which IMU data the blade height sensor device 115 can further consider when determining the blade height of the pull-behind blade 114. In another embodiment, the blade height sensor device 115 uses a laser system to determine the blade height. In the laser system, a laser transmitter is positioned at the edge of the operating environment 111. The laser transmitter is a rotating laser that emits a planar laser that is orientated level, on a single slope or as a dual slope. For example, the laser leans x degrees in an x axis and y degrees in an orthogonal (y) axis to the x axis. In the laser system, the blade height sensor device 115 includes a laser receiver that intercepts the emitted rotating laser beam output by the laser transmitter. Based on a location on the laser receiver at which the blade height sensor device 115 detects the emitted rotating laser beam, the blade height sensor device 115 determines a blade height relative to a reference height. For example, if the laser is detected in a middle area of the laser receiver, the blade height is at the reference height. If the laser is detected above the middle area of the laser receiver, the blade height is lower than the reference height. If the laser is detected below the middle area of the laser receiver, the blade height is higher than the reference height. The laser system, in certain embodiments, is used in operating environments 110 comprising planar surfaces which are flat or sloped at a constant or substantially constant slope.

In certain embodiments, the equipment 111 communicates with an operating site management computing system 130 via a network 120. In certain embodiments herein, one or more functions of the control device 112, data storage unit 117, and/or the blade height adjustment module 113 as described herein may instead be performed by an operating site management computing system 130, which communicates with the control device 112 via a network 120. For example, the operating site management computing system 130 may receive engine load sensor device 116 information, blade height sensor 115 information, design 118 information, or other information from the control device 112 via the network 120, perform blade height adjustment calculations, and transmit the blade height adjustment calculations to the control device 112 via the network 120. For example, the control device 112 receives the blade height adjustment calculations of the operating site management computing system 130 and adjusts the blade height of the tow-behind blade 114 in accordance with the received blade height adjustment calculations. In certain embodiments, a data storage unit 135 of an operating site management computing system 130, accessible to the control device 112 via a network 120, performs one or more functions of the data storage unit 117 as described herein. The data storage unit 135 includes a local or remote data storage structure accessible to the operating site management computing system 130 suitable for storing information. A data storage unit can store relevant data as one or more files, databases, matrices, computer code, etc. The data can include the design 118.

One or more of the control device 112 and the operating site management computing system 130 could include a device having a communication module capable of transmitting and receiving data over a data network 120. For instance, one or more of the control device 112 and the operating site management computing system 130 could include a server, a desktop computer, a laptop computer, a tablet computer, or other computing device with one or more processors embedded therein and/or coupled thereto, a smart phone, a handheld computer, or any other wired or wireless, processor-driven device.

Examples of the data network 120 include, but are not limited to, internet, local area network ("LAN"), wireless area network, wired area network, wide area network, and the like. For example, the data network 120 includes a wired or wireless telecommunication means by which network systems can communicate and exchange data. For example, each data network 170 can be implemented as, or may be a part of, a storage area network ("SAN"), a personal area network ("PAN"), a metropolitan area network ("MAN"), a LAN, a wide area network ("WAN"), a wireless LAN ("WLAN"), a virtual private network ("VPN"), an intranet, an Internet, a mobile telephone network, a card network, a Bluetooth network, a Bluetooth low energy ("BLE") network, a Wi-Fi network, a near field communication ("NFC") network, any form of standardized radio frequency, or any combination thereof, or any other appropriate architecture or system that facilitates communication of signals, data, and/or messages (generally referred to as data). It should be understood that the terms "data" and "information" are used interchangeably herein to refer to text, images, audio, video, or any other form of information that can exist in a computer-based environment.

Figure 2:
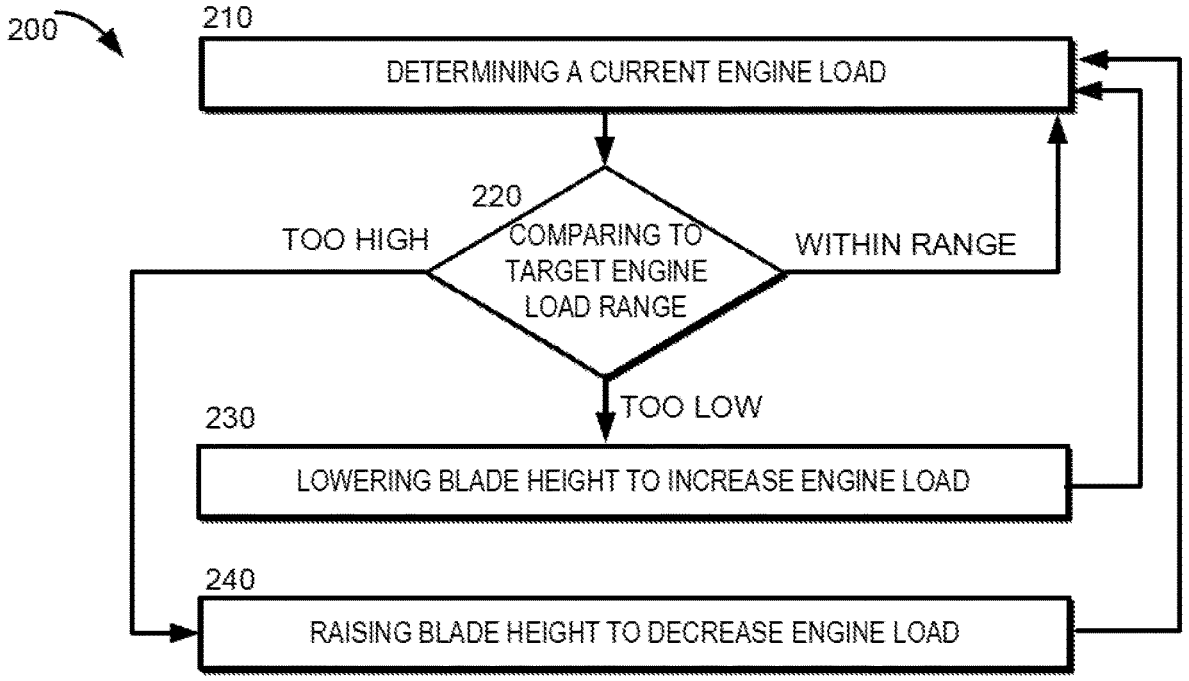
FIG. 2 depicts an example of a method for automatically adjusting a blade height during operation of an equipment to maintain a target engine load, according to certain embodiments described in the present disclosure.

Examples of Operations for Automatically Adjusting a Blade Height During Operation of an Equipment to Maintain a Target Engine Load Range FIG. 2 depicts an example of a method 200 for adjusting a blade height during operation of an equipment to maintain a target engine load range, according to certain embodiments. For illustrative purposes, the method 200 is described with reference to the components illustrated in FIG. 1, though other implementations are possible. For example, the program code for the control device 112, which is stored in a non-transitory computer-readable medium, is executed by one or more processing devices to cause the sampling computing device 130 to perform one or more operations described herein. For example, the program code for the blade height adjustment module 113, which is stored in a non-transitory computer-readable medium, is executed by one or more processing devices to cause the sampling computing device 130 to perform one or more operations described herein. One or more of these operations described in FIG. 2 as being performed by the control device 112 may instead be performed by the blade height adjustment module 113 instead of or in addition to being performed by the control device 112. In certain embodiments, one or more of these operations described in FIG. 2 as being performed by the control device 112 may be performed by the operating site management computing system 130 instead of or in addition to being performed by the control device 112.

At block 210, the method 200 involves determining, by the control device 112, a current engine load. In certain embodiments, the control device monitors a current engine load of an engine of the equipment 111 during operation of the equipment 111. A current engine load may be expressed as a percentage or other value. In certain embodiments, the equipment 111 includes an engine load sensor device 116 that determines a current engine load. The engine load sensor device 116 may include one or more sensors that detect one or more operating conditions or outputs of the engine and calculate or otherwise determines a current engine load based on the one or more operating conditions or outputs. For example, the engine load sensor device 116 determines the engine load at regular predefined intervals (e.g. at an interval within the range of 5-0.2 Hz) and communicates the engine load determination to the control device 112. The control device 112 continuously or periodically receives current engine load values from the engine load sensor device 116.

At block 220, the method 200 involves comparing, by the control device 112, the current engine load to a target engine load range. The control device 112 compares the current engine load to a target engine load range. For example, the target engine load range includes a minimum target engine load value and a maximum target engine load value. In certain embodiments, the target engine load range is an engine load range at which the operating site 110 feature modification function of the equipment 112 (e.g. by application of the blade to the surface or subsurface of the operating site 110) is most efficient. In some instances, the control device 112 determines that the current engine load is within the target engine load range. In some instances, the control device 112 determines that the current engine load is less than the target engine load range. In some instances, the control device 112 determines that the current engine load is greater than the target engine load range.

If the current engine load is within the target engine load range, the method 200 returns to block 210. When the engine load is within the target range, no adjustments to the blade height are necessary to change the engine load. In certain embodiments, the control device 112 continues to monitor, continuously or periodically, the engine load of the equipment as in block 210 and then compare the engine load of the equipment to the target range as in block 220. For example, the control device 112 may receive, from the engine load sensor device 116, engine load data continuously or periodically. The control device 112 may compare, at regular intervals (e.g. every five seconds, every 10 seconds, every thirty seconds, or other predefined interval), the current engine load data to the target engine load range and lower or raise the blade height, accordingly, as described herein, to cause the current engine load to enter or otherwise remain within the target engine load range.

Returning to block 220, if the current engine load is too low when compared to the target engine load range, the method 200 proceeds to block 230. In an example, upon comparing the current engine load to the target engine load range, the control device 112 determines that the current engine load is less than the target engine load range.

In block 230, the method 200 involves lowering, by the control device 112, the blade height to increase the engine load. Lowering the blade height of the tow-behind blade 114 increases blade engagement and generally increases the engine load. In this example, the control device 112 lowers the blade height of the tow-behind blade 114, which increases the blade engagement and increases the engine load. In certain embodiments, the control device 112 calculates an amount by which to lower the blade height to increase the engine load to within the target engine load range and lowers the blade height by the calculated amount. In certain embodiments, the control device 112 calculates a blade height setting, of a set of possible blade height settings, expected to increase the engine load to within the target engine load range. In another embodiment, the control device 112 lowers the blade height by a predefined incremental amount, determines the subsequent engine load, compares the subsequent engine load to the target load range, and further lowers the blade height by the predefined incremental amount. In this other embodiment, the control device 112 iteratively lowers the blade height by the predefined incremental amount until the engine load is determined to be within the target engine load range. After lowering the blade height, the control device 112 continues to monitor, continuously or periodically, the engine load of the equipment 111.

From block 230, the method 200 returns to block 210. In certain embodiments, the control device 112, after lowering the blade height, continues to monitor, continuously or periodically, the engine load of the equipment as in block 210 and then compare the engine load of the equipment to the target range as in block 220. For example, the control device 112 may receive, from the engine load sensor device 116, engine load data continuously or periodically. The control device 112 may compare, at regular intervals (e.g. every five seconds, every 10 seconds, every thirty seconds, or other predefined interval), the current engine load data to the target engine load range and lower or raise the blade height, accordingly, as described herein, to cause the current engine load to enter or otherwise remain within the target engine load range.

Returning to block 220, if the current engine load is too high when compared to the target engine load range, the method 200 proceeds to block 240. For example, upon comparing the current engine load to the target engine load range, the control device 112 determines that the current engine load is more than the target engine load range.

In block 240, the method 200 involves raising, by the control device 112, the blade height to decrease the engine load. Raising the blade of the tow-behind blade 114 decreases blade engagement and generally decreases the engine load. In this example, the control device 112 raises the blade height of the tow-behind blade 114, which decreases the blade engagement and decreases the engine load. In certain embodiments, the control device 112 calculates an amount by which to raise the blade height to decrease the engine load to within the target engine load range and raises the blade height by the calculated amount. In certain embodiments, the control device 112 calculates a blade height setting, of a set of possible blade height settings, expected to decrease the engine load to within the target engine load range. In another embodiment, the control device 112 raises the blade height by a predefined incremental amount, determines the subsequent engine load, compares the subsequent engine load to the target load range, and further raises the blade height by the predefined incremental amount. In this other embodiment, the control device 112 iteratively raises the blade height by the predefined incremental amount until the engine load is determined to be within the target engine load range.

From block 240, the method 200 returns to block 210. For example, after raising the blade height, the control device 112 continues to monitor, continuously or periodically, the engine load of the equipment as in block 210 and then compare the engine load of the equipment to the target range as in block 220. For example, the control device 112 may receive, from the engine load sensor device 116, engine load data continuously or periodically. The control device 112 may compare, at regular intervals (e.g. every five seconds, every 10 seconds, every thirty seconds, or other predefined interval), the current engine load data to the target engine load range and lower or raise the blade height, accordingly, as described herein, to cause the current engine load to enter or otherwise remain within the target engine load range.

Figure 3:
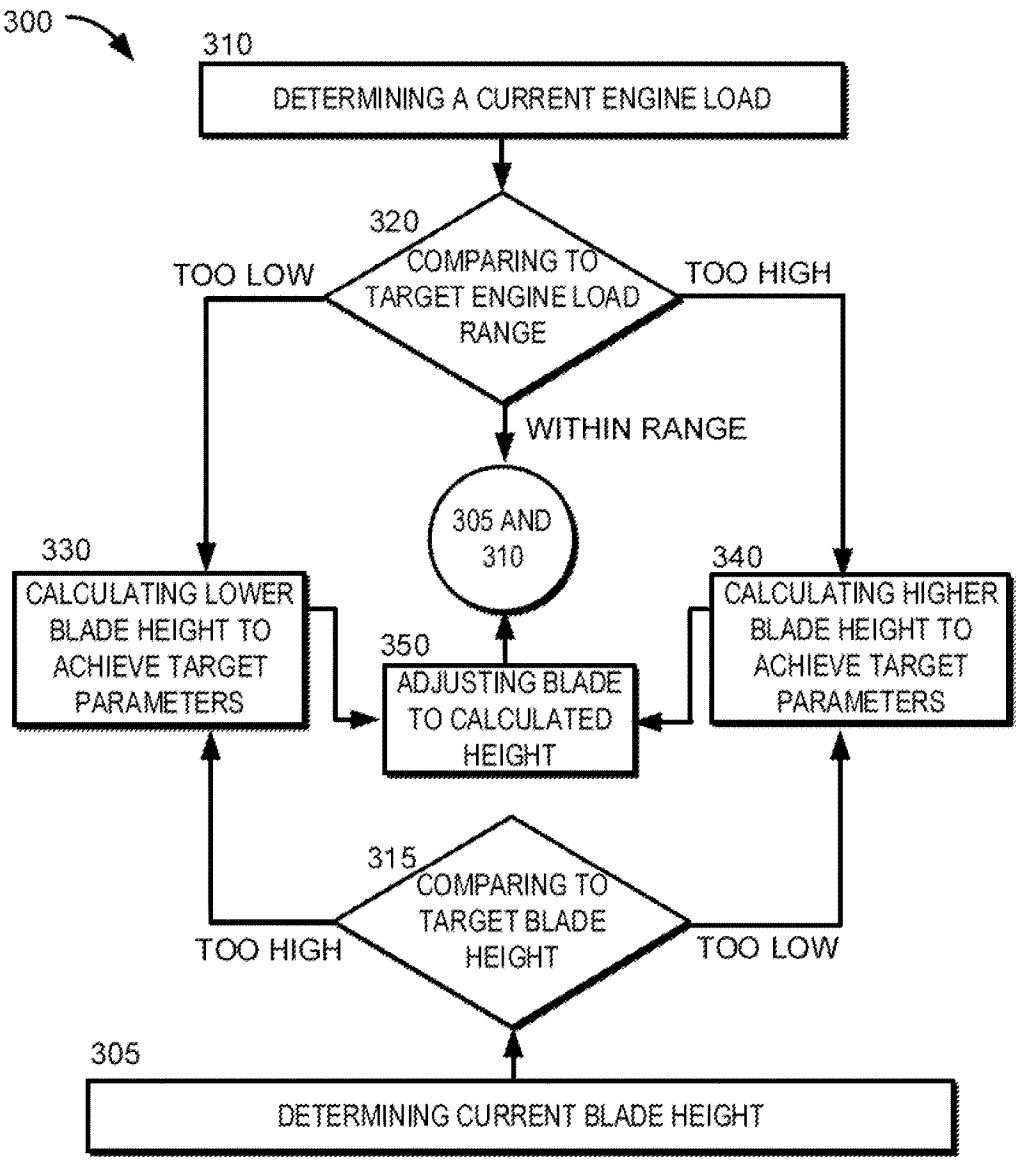
FIG. 3 depicts an example of a method for automatically adjusting a blade height during operation of an equipment to maintain a target engine load and a target blade height, according to certain embodiments described in the present disclosure.

FIG. 3 depicts an example of a method 300 for automatically adjusting a blade height during operation of an equipment to maintain a target engine load and a target blade height, according to certain embodiments. For illustrative purposes, the method 300 is described with reference to the components illustrated in FIG. 1, though other implementations are possible. For example, the program code for the control device 112, which is stored in a non-transitory computer-readable medium, is executed by one or more processing devices to cause the sampling computing device 130 to perform one or more operations described herein. For example, the program code for the blade height adjustment module 113, which is stored in a non-transitory computer-readable medium, is executed by one or more processing devices to cause the sampling computing device 130 to perform one or more operations described herein. One or more of these operations described in FIG. 3 as being performed by the control device 112 may instead be performed by the blade height adjustment module 113 instead of or in addition to being performed by the control device 112. In certain embodiments, one or more of these operations described in FIG. 3 as being performed by the control device 112 may be performed by the operating site management computing system 130 instead of or in addition to being performed by the control device 112.

In FIG. 3, in a first control loop, a control device 112 monitors a current engine load as compared to a target engine load range and calculates and makes adjustments to the blade height of the tow-behind blade 114 to maintain the engine load within the target engine load range (e.g. blocks 310, 320, 330, 340, and 350). Also, in FIG. 3, in a second control loop, the control device 112 monitors a current blade height as compared to a target blade height that is aimed to achieve a design 118 and calculates and makes adjustments to the blade height of the tow-behind blade 114 in order to modify physical features of a surface and/or subsurface of the operating site environment 110 in accordance with the design 118 (e.g. block 305, 310, 315, 330, 340, and 350). In FIG. 3, the control device 112 continuously executes the first and second control loops to make adjustments, as needed, to the blade height of the tow-behind blade 114 in order to maintain the engine load within the target range (first control loop) and maintain the current blade height as close as possible to a target blade height calculated to achieve the design 118 for the operating site environment 110.

The first control loop, for adjusting blade height as needed to maintain an engine load within a target range, as described in blocks 310, 320, 330, 340, and 350 of FIG. 3.

At block 310, the method 300 involves determining, by the control device 112, a current engine load. In certain embodiments, the control device monitors a current engine load of an engine of the equipment 111 during operation of the equipment 111. A current engine load may be expressed as a percentage or other value. In certain embodiments, the equipment 111 includes an engine load sensor device 116 that determines a current engine load. The engine load sensor device 116 may include one or more sensors that detect one or more operating conditions or outputs of the engine and calculate or otherwise determines a current engine load based on the one or more operating conditions or outputs. For example, the engine load sensor device 116 determines the engine load at regular predefined intervals (e.g. every second, every five seconds, or other predefined interval) and communicates the engine load determination to the control device 112. The control device 112 continuously or periodically receives current engine load values from the engine load sensor device 116.

At block 320, the method 200 involves comparing, by the control device 112, the current engine load to a target engine load range. The control device 112 compares the current engine load to a target engine load range. For example, the target engine load range includes a minimum target engine load value and a maximum target engine load value. In certain embodiments, the target engine load range is an engine load range at which the operating site 110 feature modification function of the equipment 112 (e.g. by application of the blade to the surface or subsurface of the operating site 110) is most efficient. In some instances, the control device 112 determines that the current engine load is within the target engine load range. In some instances, the control device 112 determines that the current engine load is less than the target engine load range. In some instances, the control device 112 determines that the current engine load is greater than the target engine load range.

If the current engine load is within the target engine load range, the method 300 returns to block 310 of the first control loop and also to block 305 of the second control loop. When the engine load is within the target range, no adjustments to the blade height are necessary to change the engine load. In certain embodiments, the control device 112 continues to monitor, continuously or periodically, the engine load of the equipment as in block 310 and then compare the engine load of the equipment to the target range as in block 320. For example, the control device 112 may receive, from the engine load sensor device 116, engine load data continuously or periodically. The control device 112 may compare, at regular intervals (e.g. every five seconds, every 10 seconds, every thirty seconds, or other predefined interval), the current engine load data to the target engine load range and lower or raise the blade height, accordingly, as described herein, to cause the current engine load to enter or otherwise remain within the target engine load range.

Returning to block 320, if the current engine load is too low when compared to the target engine load range, the method 300 proceeds to block 330. In an example, upon comparing the current engine load to the target engine load range, the control device 112 determines that the current engine load is less than the target engine load range.

In block 330, the method 300 involves calculating, by the control device 112, an amount by which to lower the blade height to achieve target parameters. In the first control loop, the target parameters are the target engine load range. Lowering the blade height of the tow-behind blade 114 increases blade engagement and generally increases the engine load. Accordingly, in some embodiments, the control device 112 estimates a height to which to lower the blade of the tow-behind blade 114 so that the engine load of the equipment is increased to within the target engine load range. In some embodiments, the control device 112 calculates a blade height setting, of a set of possible blade height settings, expected to increase the engine load to within the target engine load range. In another embodiment, the control device 112 determines to lower the blade height by a predefined incremental amount. From block 330, the method 300 proceeds to block 350.

At block 350, the method 300 involves adjusting, by the control device 112, the blade to the calculated height. For example, the control device 112 lowers the blade height of the tow behind blade to the calculated height to increase the engine load. For example, the control device 112 lowers the blade to the calculated height, to the calculated height setting, or otherwise lowers the blade by the predetermined amount.

From block 350, the method 300 returns to block 310. In certain embodiments, the control device 112, after lowering the blade height, continues to monitor, continuously or periodically, the engine load of the equipment 111 as described in block 310 and then compare the engine load of the equipment 111 to the target range as described in block 320. For example, the control device 112 may receive, from the engine load sensor device 116, engine load data continuously or periodically. The control device 112 may compare, at regular intervals (e.g. every five seconds, every 10 seconds, every thirty seconds, or other predefined interval), the current engine load data to the target engine load range and lower or raise the blade height, accordingly, as described herein, to cause the current engine load to enter or otherwise remain within the target engine load range.

Returning to block 320, if the current engine load is too high when compared to the target engine load range, the method 300 proceeds to block 340. For example, upon comparing the current engine load to the target engine load range, the control device 112 determines that the current engine load is more than the target engine load range.

In block 340, the method 300 involves calculating, by the control device 112, an amount by which to raise the blade height to achieve target parameters. In the first control loop, the target parameters are the target engine load range. Raising the blade height of the tow-behind blade 114 decreases blade engagement and generally decreases the engine load. Accordingly, in some embodiments, the control device 112 estimates a height to which to raise the blade of the tow-behind blade 114 so that the engine load of the equipment is decreased to within the target engine load range. In some embodiments, the control device 112 calculates a blade height setting, of a set of possible blade height settings, expected to decrease the engine load to within the target engine load range. In another embodiment, the control device 112 determines to raise the blade height by a predefined incremental amount. From block 340, the method 300 proceeds to block 350.

At block 350, the method 300 involves adjusting, by the control device 112, the blade to the calculated height. For example, the control device 112 raises the blade height of the tow behind blade to the calculated height to decrease the engine load. For example, the control device 112 raises the blade to the calculated height, to the calculated height setting, or otherwise raises the blade by the predetermined amount.

From block 350, the method 300 returns to block 310. In certain embodiments, the control device 112, after raising the blade height, continues to monitor, continuously or periodically, the engine load of the equipment 111 as described in block 310 and then compare the engine load of the equipment 111 to the target range as described in block 320. For example, the control device 112 may receive, from the engine load sensor device 116, engine load data continuously or periodically. The control device 112 may compare, at regular intervals (e.g. every five seconds, every 10 seconds, every thirty seconds, or other predefined interval), the current engine load data to the target engine load range and lower or raise the blade height, accordingly, as described herein, to cause the current engine load to enter or otherwise remain within the target engine load range.

The first control loop as described in blocks 310, 320, 330, 340, and 350 of FIG. 3 is executed by the control device 112 alternatingly with, back and forth with, or otherwise continuously and simultaneously with the second control loop described in blocks 305, 315, 330, 340, and 350 of FIG. 3. In other embodiments, a control loop described in FIG. 2 is executed by the control device 112 alternatingly with, back and forth with, or otherwise continuously and simultaneously with the second control loop described in blocks 305, 315, 330, 340, and 350 of FIG. 3. The second control loop begins at block 305 of FIG. 3.

At block 305, the method 300 involves determining, by the control device 112, a current blade height. From block 305, the method 300 proceeds to block 315. In certain embodiments, the tow-behind blade 114 includes blade height sensor device 115 that determines a current blade height. The blade height sensor device 115 may include one or more sensors that detect a blade height, for example, GNSS receivers, IMUs, and/or laser receivers which detect laser beams emitted by laser devices positioned at one or more locations in the operating site environment 111. The blade height sensor device 115 communicates, at periodic intervals or continuously, a detected blade height to the control device 112, for example, via a local wired or wireless network connection. The control device 112 receives, at periodic intervals or continuously, via the local wired or wireless network connection, blade height information from the blade height sensor device 115 indicating a current blade height of the blade of the tow-behind blade 114.

At block 315, the method 300 involves comparing, by the control device 112, the current blade height of the tow-behind blade 114 to a target blade height. The target blade height is defined by the design 118. In certain embodiments, the control device 112 accesses the design 118 in the data storage unit 117. In certain examples, the design 118 specifies target physical surface or subsurface characteristics of the operating site environment 110. In certain examples, the design 118 indicates a topography or other measures or bounds describing the target physical surface or subsurface characteristics. For example, the design 118 may indicate target surface heights for each area of a surface of the operating site environment 110 compared to a reference height. In an example, the control device 112 compares a target surface height for an operating area of the tow-behind blade 114 against a current blade height for the tow behind blade 114. In certain embodiments (e.g. when using a GSSN blade height sensor device), the current blade height and the target blade height are expressed in comparison to a reference value (e.g. a distance above sea level). In certain embodiments (e.g. when using a laser system blade height sensing device) a reference blade height is defined as a blade height at which, when detecting a laser beam emitted by a laser transmitting device at an edge of the operating site environment 110, the laser beam is received at a particular point on a laser receiver device. In these embodiments, the current blade height can be calculated based on how far the point at which the laser beam is received on the receiver device deviates from the particular point. In these embodiments, an operator positions one or more laser transmitter devices in the operating environment such that, at any position within the operating environment, the blade height sensing device 115 receives an emitted laser beam from at least one of the one or more laser transmitter devices at a particular position on the blade height sensing device 115 when the current blade height of the equipment corresponds to a blade height indicated by the design.

If the control device 112 determines that the current blade height is higher than the target blade height, the method 300 proceeds to block 330. In an example, for a current area in which the tow-behind blade 114 is operating, the control device 112 compares a target surface height for the operating area, for example, 1.25 meters above sea level (or other reference height) and compares it against the current blade height, for example, 1.85 meters above sea level (or other reference height), a difference of 0.60 meters. In another example, for the current area in which the tow-behind blade 114 is operating, the control device 112 determines, based on a position in the laser receiver of the blade height sensing device 115 in comparison to a reference point, that the current blade height is 0.60 meters above a reference height.

At block 330, the method 300 involves calculating a lower blade height to achieve target parameters. The target parameters are the target blade height for the current operating area of the tow-behind blade 114. From block 330, the method 300 proceeds to block 350. Continuing with the previous example from block 320, the control device 112 determines that the blade must cut a distance of 0.60 meters (60 centimeters) further into the operating site environment 110 to reach the target surface height for the area. For example, the control device 112 determines a blade height adjustment amount corresponding to a difference between the target surface height for the operating area and a current blade height. In certain embodiments, the blade height adjustment amount is a specific distance which to lower the blade height. In other embodiments, the blade height adjustment amount is a specific height setting, of a set of potential blade height settings, to which the blade height should be lowered. In yet other embodiments, the blade height adjustment amount is a predetermined adjustment amount by which the blade height should be lowered.

At block 350, the method 300 involves adjusting the blade height to the calculated height. For example, the control device 112 lowers the blade height of the blade of the tow behind blade 114 to the calculated height to reach the target blade height. For example, the control device 112 lowers the blade to the calculated height, to the calculated height setting, or otherwise lowers the blade by the predetermined amount. From block 350, the method 300, in the second control loop, returns to block 305. In certain embodiments, the control device 112, after lowering the blade height, continues to monitor, continuously or periodically, the current blade height as well as target blade height (in accordance with the design 118) of the tow-behind blade 114 as described in block 305 and then compare the current blade height to the target blade height as described in block 315. For example, the control device 112 may receive, from the blade height sensor device 115, current blade height information continuously or periodically. The control device 112 may compare, at regular intervals (e.g. every five seconds, every 10 seconds, every thirty seconds, or other predefined interval), the current blade height to the target blade height and lower or raise the blade height, accordingly, as described herein, to cause the current blade height to equal or to approach the target blade height for the current operating area of the operating site environment 110.

Returning to block 315, if the control device 112 determines that the current blade height is lower than the target blade height, the method 300 proceeds to block 340. In an example, for a current area in which the tow-behind blade 114 is operating, the control device 112 compares a target surface height for the operating area, for example, 1.25 meters above sea level (or other reference height) and compares it against the current blade height, for example, 1.20 meters above sea level (or other reference height), a different of −0.05 meters. In another example, for the current area in which the tow-behind blade 114 is operating, the control device 112 determines, based on a position in the laser receiver of the blade height sensing device 115 in comparison to a reference point, that the current blade height is 0.05 meters below a reference height.

At block 330, the method 300 involves calculating a higher blade height to achieve target parameters. From block 330, the method 300 proceeds to block 350. Continuing with the previous example from block 320, the control device 112 determines that the blade must cut a distance of −0.05 meters (−5 centimeters) less into the operating site environment 110 to reach the target surface height for the area. For example, the control device 112 determines a blade height adjustment amount corresponding to a difference between the target surface height for the operating area and a current blade height. In certain embodiments, the blade height adjustment amount is a specific distance which to raise the blade height. In other embodiments, the blade height adjustment amount is a specific height setting, of a set of potential blade height settings, to which the blade height should be raised. In yet other embodiments, the blade height adjustment amount is a predetermined adjustment amount by which the blade height should be raised.

At block 350, the method 300 involves adjusting the blade height to the calculated height. For example, the control device 112 raises the blade height of the tow-behind blade 114 to the calculated height to reach the target blade height. For example, the control device 112 raises the blade to the calculated height, to the calculated height setting, or otherwise raises the blade by the predetermined amount. From block 350, the method 300, in the second control loop, returns to block 305. In certain embodiments, the control device 112, after raising the blade height, continues to monitor, continuously or periodically, the current blade height as well as target blade height (in accordance with the design 118) of the tow-behind blade 114 as described in block 305 and then compare the current blade height to the target blade height as described in block 315. For example, the control device 112 may receive, from the blade height sensor device 115, current blade height information continuously or periodically. The control device 112 may compare, at regular intervals (e.g. every five seconds, every 10 seconds, every thirty seconds, or other predefined interval), the current blade height to the target blade height and lower or raise the blade height, accordingly, as described herein, to cause the current blade height to equal or to approach the target blade height for the current operating area of the operating site environment 110.

Example of a Computing System for Implementing Certain Embodiments

Figure 4:
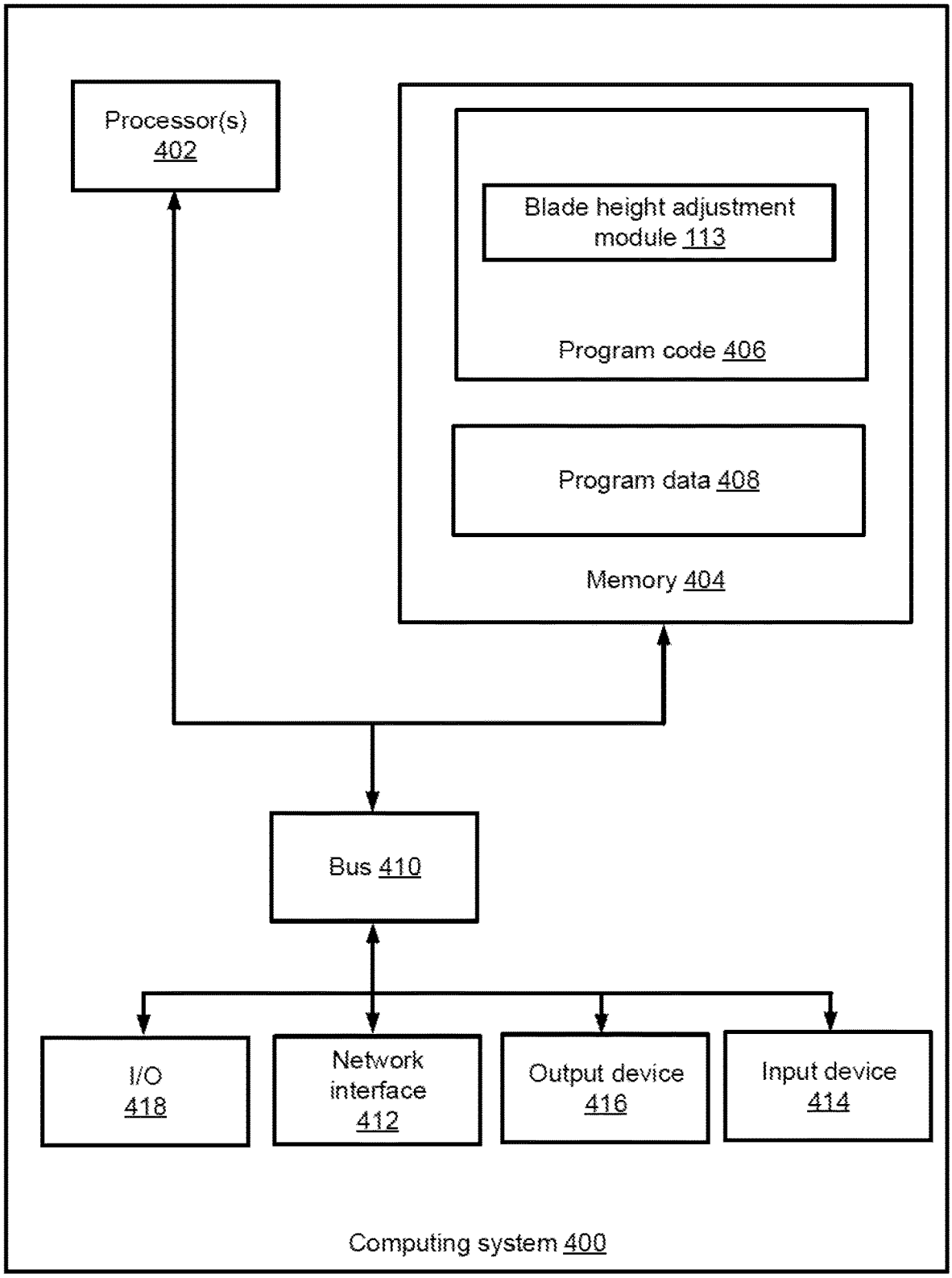
FIG. 4 depicts an example of a computing system that performs certain operations described herein, according to certain embodiments described in the present disclosure.

Any suitable computing system or group of computing systems can be used for performing the operations described herein. For example, FIG. 4 depicts an example of a computing system 400. The computing system 400, in certain embodiments, includes the operating site management computing system 130 and/or the control device 112.

The depicted examples of a computing system 400 includes a processor 402 communicatively coupled to one or more memory devices 404. The processor 402 executes computer-executable program code stored in a memory device 404, accesses information stored in the memory device 804, or both. Examples of the processor 402 include a microprocessor, an application-specific integrated circuit ("ASIC"), a field-programmable gate array ("FPGA"), or any other suitable processing device. The processor 402 can include any number of processing devices, including a single processing device.

The memory device 404 includes any suitable non-transitory computer-readable medium for storing data, program code, or both. A computer-readable medium can include any electronic, optical, magnetic, or other storage device capable of providing a processor with computer-readable instructions or other program code. Non-limiting examples of a computer-readable medium include a magnetic disk, a memory chip, a ROM, a RAM, an ASIC, optical storage, magnetic tape or other magnetic storage, or any other medium from which a processing device can read instructions.

The computing system 400 executes program code 406 that configures the processor 802 to perform one or more of the operations described herein. The program code 406 includes, for example, the blade height adjustment module 113 or other suitable applications that perform one or more operations described herein in FIG. 2 and/or FIG. 3, for example, one or more functions herein described as performed by the control device 112 and data storage unit 117. The program code 406 may be resident in the memory device 404 or any suitable computer-readable medium and may be executed by the processor 402 or any other suitable processor. The program code could include processor-specific instructions generated by a compiler or an interpreter from code written in any suitable computer-programming language, including, for example, C, C++, C#, Visual Basic, Java, Python, Perl, JavaScript, and ActionScript.

In some embodiments, program code 406 for implementing the blade height adjustment module 113 is stored in the memory device 404, as depicted in FIG. 4. In additional or alternative embodiments, program code 406 for implementing one or more of the blade height adjustment module 113 are stored in different memory devices of different computing systems. In additional or alternative embodiments, the program code 406 described above is stored in one or more other memory devices accessible via a data network (e.g. data network 120).

The computing system 400 can access program data 407, which includes one or more of the data described herein (e.g. the design 118), in any suitable manner. In some embodiments, some or all of one or more of these data sets, models, and functions are stored as the program data 407 in the memory device 404, as in the example depicted in FIG. 4. In additional or alternative embodiments, one or more of these data sets, models, and functions are stored in the same memory device (e.g., one of the memory device 404). For example, a common computing system, such as the operating site management computing system 130 depicted in FIG. 1, can include hardware, software, or both that implements the blade height adjustment module 113. In additional or alternative embodiments, one or more of the programs, data sets, models, and functions described herein are stored in one or more other memory devices accessible via a data network.

The computing system 400 also includes a network interface device 412. The network interface device 412 includes any device or group of devices suitable for establishing a wired or wireless data connection to one or more data networks. Non-limiting examples of the network interface device 412 include an Ethernet network adapter, a modem, and the like. The computing system 400 is able to communicate with one or more other computing devices (e.g., control device 112, engine load sensor device 116, blade height sensor device 115) via a data network using the network interface device 410.

The computing system 400 may also include a number of external or internal devices, such as input or output devices. For example, the computing system 400 is shown with one or more input/output ("I/O") interfaces 418. An I/O interface 418 can receive input from input devices or provide output to output devices. One or more buses 410 are also included in the computing system 400. The bus 410 communicatively couples one or more components of a respective one of the computing system 400.

In some embodiments, the computing system 400 also includes the input device 414 and the presentation device 416 depicted in FIG. 4. An input device 414 can include any device or group of devices suitable for receiving visual, auditory, or other suitable input that controls or affects the operations of the processor 402. Non-limiting examples of the input device 414 include a touchscreen, a mouse, a keyboard, a microphone, a separate mobile computing device, etc. A presentation device 416 can include any device or group of devices suitable for providing visual, auditory, or other suitable sensory output. Non-limiting examples of the presentation device 416 include a touchscreen, a monitor, a speaker, a separate mobile computing device, etc.

Although FIG. 4 depicts the input device 414 and the presentation device 416 as being local to the computing device that executes the program code 406, other implementations are possible. For instance, in some embodiments, one or more of the input device 414 and the presentation device 416 can include a remote client-computing device that communicates with the computing system 400 via the network interface device 412 using one or more data networks described herein.

Embodiments may comprise a computer program that embodies the functions described and illustrated herein, wherein the computer program is implemented in a computer system that comprises instructions stored in a machine-readable medium and a processor that executes the instructions. However, it should be apparent that there could be many different ways of implementing embodiments in computer programming, and the embodiments should not be construed as limited to any one set of computer program instructions. Further, a skilled programmer would be able to write such a computer program to implement an embodiment of the disclosed embodiments based on the appended flow charts and associated description in the application text. Therefore, disclosure of a particular set of program code instructions is not considered necessary for an adequate understanding of how to make and use embodiments. Further, those skilled in the art will appreciate that one or more aspects of embodiments described herein may be performed by hardware, software, or a combination thereof, as may be embodied in one or more computer systems. Moreover, any reference to an act being performed by a computer should not be construed as being performed by a single computer as more than one computer may perform the act.

The example embodiments described herein can be used with computer hardware and software that perform the methods and processing functions described previously. The systems, methods, and procedures described herein can be embodied in a programmable computer, computer-executable software, or digital circuitry. The software can be stored on computer-readable media. For example, computer-readable media can include a floppy disk, RAM, ROM, hard disk, removable media, flash memory, memory stick, optical media, magneto-optical media, CD-ROM, etc. Digital circuitry can include integrated circuits, gate arrays, building block logic, field programmable gate arrays (FPGA), etc.

Figure 5:
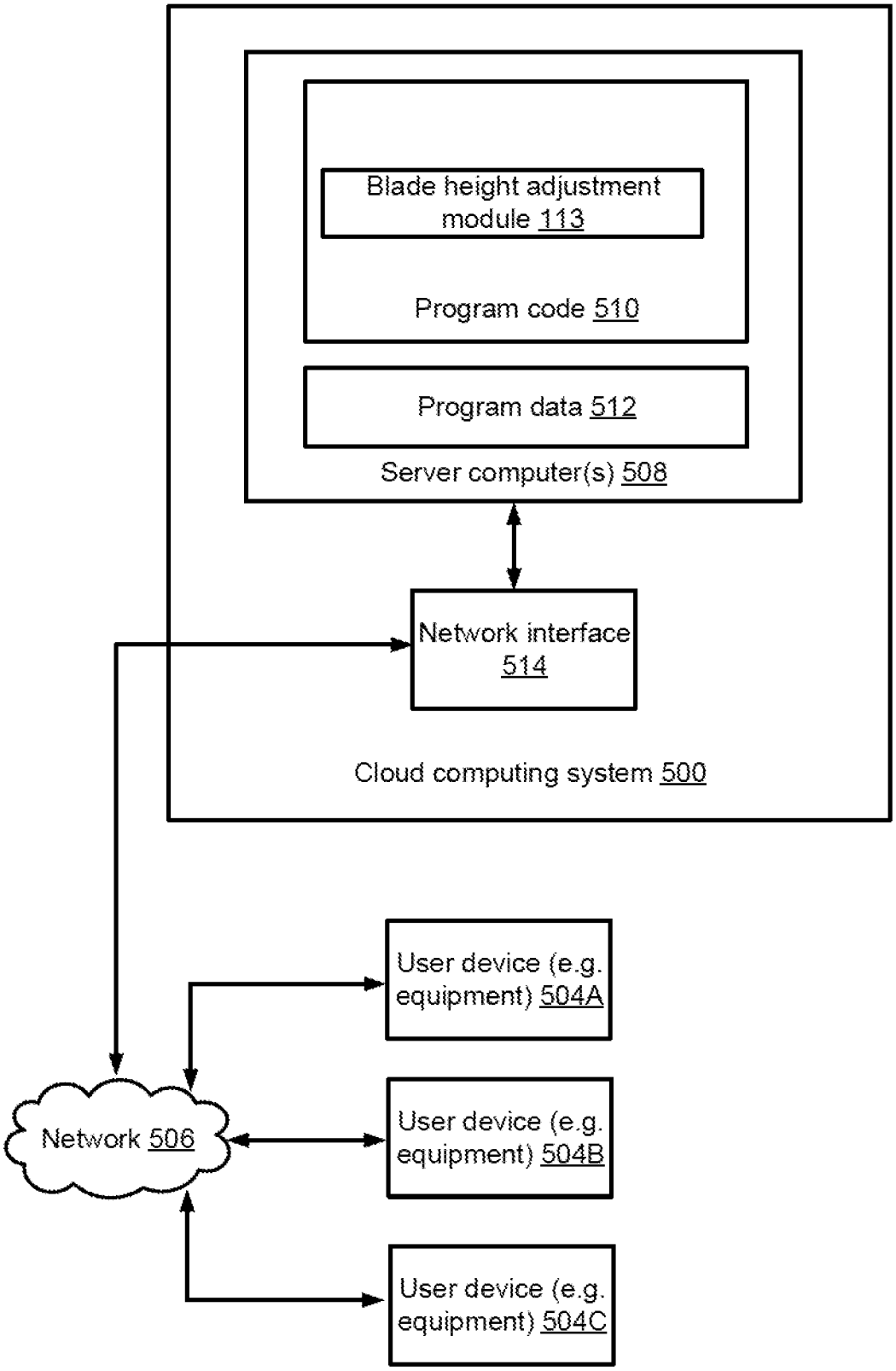
FIG. 5 depicts an example of a cloud computing system that performs certain operations described herein, according to certain embodiments described in the present disclosure.

In some embodiments, the functionality provided by computer system 400 may be offered as cloud services by a cloud service provider. For example, FIG. 5 depicts an example of a cloud computer system 500 offering the blade height adjustment module 113 that can be used by a number of user subscribers using user devices 504A, 504B, and 504C across a data network 506. For example, the user devices 504A, 504B, 504C may be equipment (including respective tow-behind blades 114) at one or more operating site environments 110. In the example, the equipment the blade height adjustment module 113 may be offered under a Software as a Service (SaaS) model. One or more users may subscribe to the blade height adjustment service, and the cloud computer system 500 performs the functions of the blade height adjustment module 113 to subscribers. For example, the cloud computer system 500 performs services comprising one or more of steps or functions illustrated in FIG. 1, FIG. 2, and FIG. 3 and described herein. The cloud computer system 500 may include one or more remote server computers 508.

The remote server computers 508 include any suitable non-transitory computer-readable medium for storing program code 510 (e.g. the blade height adjustment module 113) and program data 512, or both, which is used by the cloud computer system 500 for providing the cloud services. A computer-readable medium can include any electronic, optical, magnetic, or other storage device capable of providing a processor with computer-readable instructions or other program code. Non-limiting examples of a computer-readable medium include a magnetic disk, a memory chip, a ROM, a RAM, an ASIC, optical storage, magnetic tape or other magnetic storage, or any other medium from which a processing device can read instructions. The instructions may include processor-specific instructions generated by a compiler or an interpreter from code written in any suitable computer-programming language, including, for example, C, C++, C#, Visual Basic, Java, Python, Perl, JavaScript, and ActionScript. In various examples, the server computers 908 can include volatile memory, non-volatile memory, or a combination thereof.

One or more of the server computers 508 execute the program code 510 that configures one or more processors of the server computers 508 to perform one or more of the operations that provide one or more methods described herein (e.g. the methods of FIG. 2, FIG. 3 described herein). As depicted in the embodiment in FIG. 5, the one or more servers may implement the blade height adjustment module 113. Any other suitable systems or subsystems that perform one or more operations described herein (e.g., one or more development systems for configuring an interactive user interface) can also be implemented by the cloud computer system 500.

In certain embodiments, the cloud computer system 500 may implement the services by executing program code and/or using program data 512, which may be resident in a memory device of the server computers 508 or any suitable computer-readable medium and may be executed by the processors of the server computers 508 or any other suitable processor.

In some embodiments, the program data 512 includes one or more datasets and models described herein. Examples of these datasets include training data. In some embodiments, one or more of data sets, models, and functions are stored in the same memory device. In additional or alternative embodiments, one or more of the programs, data sets, models, and functions described herein are stored in different memory devices accessible via the data network 506.

The cloud computer system 500 also includes a network interface device 514 that enables communications to and from cloud computer system 500. In certain embodiments, the network interface device 514 includes any device or group of devices suitable for establishing a wired or wireless data connection to the data networks 506. Non-limiting examples of the network interface device 514 include an Ethernet network adapter, a modem, and/or the like. The blade height adjustment service is able to communicate with the user devices 504A, 504B, and 504C via the data network 506 using the network interface device 514.

The example systems, methods, and acts described in the embodiments presented previously are illustrative, and, in alternative embodiments, certain acts can be performed in a different order, in parallel with one another, omitted entirely, and/or combined between different example embodiments, and/or certain additional acts can be performed, without departing from the scope and spirit of various embodiments. Accordingly, such alternative embodiments are included within the scope of claimed embodiments.

Although specific embodiments have been described above in detail, the description is merely for purposes of illustration. It should be appreciated, therefore, that many aspects described above are not intended as required or essential elements unless explicitly stated otherwise. Modifications of, and equivalent components or acts corresponding to, the disclosed aspects of the example embodiments, in addition to those described above, can be made by a person of ordinary skill in the art, having the benefit of the present disclosure, without departing from the spirit and scope of embodiments defined in the following claims, the scope of which is to be accorded the broadest interpretation so as to encompass such modifications and equivalent structures.

General Considerations

Numerous specific details are set forth herein to provide a thorough understanding of the claimed subject matter. However, those skilled in the art will understand that the claimed subject matter may be practiced without these specific details. In other instances, methods, apparatuses, or systems that would be known by one of ordinary skill have not been described in detail so as not to obscure claimed subject matter.

Unless specifically stated otherwise, it is appreciated that throughout this specification discussions utilizing terms such as "processing," "computing," "calculating," "determining," and "identifying" or the like refer to actions or processes of a computing device, such as one or more computers or a similar electronic computing device or devices, that manipulate or transform data represented as physical electronic or magnetic quantities within memories, registers, or other information storage devices, transmission devices, or display devices of the computing platform.

The system or systems discussed herein are not limited to any particular hardware architecture or configuration. A computing device can include any suitable arrangement of components that provide a result conditioned on one or more inputs. Suitable computing devices include multi-purpose microprocessor-based computer systems accessing stored software that programs or configures the computing system from a general purpose computing apparatus to a specialized computing apparatus implementing one or more embodiments of the present subject matter. Any suitable programming, scripting, or other type of language or combinations of languages may be used to implement the teachings contained herein in software to be used in programming or configuring a computing device.

Embodiments of the methods disclosed herein may be performed in the operation of such computing devices. The order of the blocks presented in the examples above can be varied—for example, blocks can be re-ordered, combined, and/or broken into sub-blocks. Certain blocks or processes can be performed in parallel.

The use of "adapted to" or "configured to" herein is meant as open and inclusive language that does not foreclose devices adapted to or configured to perform additional tasks or steps. Additionally, the use of "based on" is meant to be open and inclusive, in that a process, step, calculation, or other action "based on" one or more recited conditions or values may, in practice, be based on additional conditions or values beyond those recited. Headings, lists, and numbering included herein are for ease of explanation only and are not meant to be limiting.

While the present subject matter has been described in detail with respect to specific embodiments thereof, it will be appreciated that those skilled in the art, upon attaining an understanding of the foregoing, may readily produce alterations to, variations of, and equivalents to such embodiments. Accordingly, it should be understood that the present disclosure has been presented for purposes of example rather than limitation, and does not preclude the inclusion of such modifications, variations, and/or additions to the present subject matter as would be readily apparent to one of ordinary skill in the art.

The invention claimed is:

1. A non-transitory computer-readable storage medium comprising computer-executable instructions that when executed by a processor cause the processor to perform steps comprising:

executing a first control loop and a second control loop;

wherein the first control loop comprises:

receiving, from an engine load sensor device, a value of an engine load of an engine of an equipment operating in an operating environment;

comparing the value of the engine load to a target engine load range defined by a minimum target engine load value and a maximum target engine load value;

responsive to determining that the value of the engine load is less than the minimum target engine load value, lowering a cutting blade of the equipment to increase an engagement of the cutting blade with a surface or subsurface of the operating environment; and responsive to determining that the engine load is greater than the maximum target engine load value, raising the cutting blade of the equipment to decrease the engagement of the cutting blade with the surface or subsurface of the operating environment;

wherein the second control loop comprises:

receiving, from a blade height sensor device, a blade height value indicating a current blade height of the cutting blade of the equipment;

accessing a design indicating a target surface or subsurface height for the operating environment, the design defining a target blade height;

comparing the current blade height to the target blade height;

responsive to determining that the current blade height is higher than the target blade height, adjusting the cutting blade lower by a predetermined incremental amount;

responsive to determining that the current blade height is lower than the target blade height, calculating a higher blade height to achieve target parameters; and adjusting the cutting blade to the calculated higher blade height;

wherein the first control loop is executed alternatingly with the second control loop so that each pass of the first control loop is followed by a pass of the second control loop.

2. The non-transitory computer-readable storage medium of claim 1, wherein a tow-behind blade comprises the cutting blade of the equipment, and wherein the equipment operating in the operating environment comprises the equipment pulling the tow-behind blade, wherein the tow-behind blade engages with the surface or subsurface of the operating environment.

3. The non-transitory computer-readable storage medium of claim 1, wherein the value of the engine load comprises a measurement of torque of the engine.

4. The non-transitory computer-readable storage medium of claim 1, wherein the value of the engine load is expressed as a percentage.

5. The non-transitory computer-readable storage medium of claim 1, wherein the maximum target engine load value is about 90%.

6. A computer-implemented method, comprising, executing a first control loop and a second control loop using a control computing device to control a height of a cutting blade during operation of a work vehicle within an operating site;

wherein the first control loop comprises:

determining a target engine load range based on features of the operating site, wherein the target engine load range is defined by a minimum target engine load value and a maximum target engine load value separated by a range of engine load values;

receiving, from an engine load sensor device, a value of an engine load of an engine of the work vehicle operating within the operating site;

comparing the value of the engine load to the target engine load range;

responsive to determining that the value of the engine load is less than the minimum target engine load value, lowering a cutting blade of the work vehicle to increase an engagement of the cutting blade with a surface or subsurface of the operating site; and responsive to determining that the engine load is greater than the maximum target engine load value, raising the cutting blade of the work vehicle to decrease the engagement of the cutting blade with the surface or subsurface of the operating site;

wherein the second control loop comprises:

receiving, from a blade height sensor device, a blade height value indicating a current blade height of the cutting blade of the work vehicle;

accessing a design indicating a target surface or subsurface height for the operating site, the design defining a target blade height;

comparing the current blade height to the target blade height;

responsive to determining that the current blade height is higher than the target blade height, calculating a lower blade height to achieve target parameters, and adjusting the cutting blade lower by a predetermined amount;

responsive to determining that the current blade height is lower than the target blade height, calculating a higher blade height to achieve target parameters; and adjusting the cutting blade to the calculated higher blade height;

wherein the first control loop is executed back and forth with the second control loop so that each pass of the first control loop is followed by a pass of the second control loop.

7. The computer-implemented method of claim 6, wherein a tow-behind blade comprises the cutting blade of the work vehicle, and wherein the work vehicle operating in the operating site comprises the work vehicle pulling the tow-behind blade, wherein the tow-behind blade engages with the surface or subsurface of the operating site.

8. The computer-implemented method of claim 6, wherein the value of the engine load comprises a measurement of torque of the engine.

9. The computer-implemented method of claim 6, wherein the value of the engine load is expressed as a percentage.

10. The computer-implemented method of claim 6, wherein the maximum target engine load value is about 90%.

11. A system, comprising:

one or more processors; and a non-transitory computer-readable storage medium comprising computer-executable instructions that, when executed by the one or more processors, cause the system to:

execute a first control loop and a second control loop;

wherein executing the first control loop causes the system to:

receive, from an engine load sensor device, a value of an engine load of an engine of an equipment operating in an operating environment;

compare the value of the engine load to a target engine load range defined by a minimum target engine load value and a maximum target engine load value;

responsive to determining that the value of the engine load is less than the minimum target engine load value, lower a cutting blade of the equipment to increase an engagement of the cutting blade with a surface or subsurface of the operating environment; and responsive to determining that the engine load is greater than the maximum target engine load value, raise the cutting blade of the equipment to decrease the engagement of the cutting blade with the surface or subsurface of the operating environment;

wherein executing the second control loop causes the system to:

receive, from a blade height sensor device, a blade height value indicating a current blade height of the cutting blade of the equipment;

access a design indicating a target surface or subsurface height for the operating environment, the design defining a target blade height;

compare the current blade height to the target blade height;

responsive to determining that the current blade height is higher than the target blade height, calculate a lower blade height to achieve target parameters, and adjust the cutting blade lower by a predetermined incremental amount;

responsive to determining that the current blade height is lower than the target blade height, calculate a higher blade height to achieve target parameters; and adjust the cutting blade to the calculated higher blade height;

wherein the first control loop is executed alternatingly with the second control loop.

12. The system of claim 11, wherein a tow-behind blade comprises the cutting blade of the equipment, and wherein the equipment operating in the operating environment comprises the equipment pulling the tow-behind blade, wherein the tow-behind blade engages with the surface or subsurface of the operating environment.

13. The system of claim 11, wherein the value of the engine load comprises a measurement of torque of the engine.

14. The system of claim 11, wherein the value of the engine load is expressed as a percentage.

15. The system of claim 11, wherein the maximum target engine load value is about 90%.

* * * * *